US008154497B2

(12) United States Patent
Lee et al.

(10) Patent No.: US 8,154,497 B2
(45) Date of Patent: Apr. 10, 2012

(54) DRIVING APPARATUS FOR DISPLAY DEVICE

(75) Inventors: Seung-Woo Lee, Seoul (KR); Tae-Sung Kim, Suwon-si (KR); Jae-Hyoung Park, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 744 days.

(21) Appl. No.: 11/473,680

(22) Filed: Jun. 23, 2006

(65) Prior Publication Data

US 2007/0018922 A1 Jan. 25, 2007

(30) Foreign Application Priority Data

Jul. 20, 2005 (KR) ..... 10-2005-0065808

(51) Int. Cl.
*G09G 3/36* (2006.01)

(52) U.S. Cl. ..... 345/100; 345/94; 345/96; 345/89; 345/204; 345/694

(58) Field of Classification Search ..... 345/89, 345/100, 94–96, 204, 209, 694
See application file for complete search history.

(56) References Cited

U.S. PATENT DOCUMENTS

| | | | | |
|---|---|---|---|---|
| 5,629,723 | A * | 5/1997 | West et al. | 345/539 |
| 5,748,276 | A * | 5/1998 | Uno et al. | 349/144 |
| 6,781,532 | B2 | 8/2004 | Wei | 341/122 |
| 2002/0140364 | A1* | 10/2002 | Inukai | 315/169.3 |
| 2003/0122761 | A1* | 7/2003 | Hong | 345/89 |
| 2004/0094765 | A1* | 5/2004 | Yamazaki et al. | 257/59 |
| 2004/0125067 | A1* | 7/2004 | Kim et al. | 345/98 |
| 2007/0013725 | A1* | 1/2007 | Burkhardt et al. | 345/690 |
| 2008/0024411 | A1* | 1/2008 | Hsieh et al. | 345/89 |

FOREIGN PATENT DOCUMENTS

| | | | |
|---|---|---|---|
| CN | 1438621 | | 8/2003 |
| CN | 1621928 | | 6/2005 |
| CN | 1648971 | | 8/2005 |
| JP | 03-078790 | A | 4/1991 |
| JP | 06-308454 | A | 11/1994 |
| JP | 07-099451 | | 4/1995 |
| JP | 07-121141 | | 5/1995 |
| JP | 08-248385 | A | 9/1996 |
| JP | 09-026765 | A | 1/1997 |
| JP | 11-337909 | A | 12/1999 |

(Continued)

*Primary Examiner* — Lun-Yi Lao
*Assistant Examiner* — Jarurat Suteerawongsa
(74) *Attorney, Agent, or Firm* — Cantor Colburn LLP

(57) ABSTRACT

A driving apparatus for a display device includes a plurality of pixels arranged in a matrix, and each pixel includes first and second sub-pixels. The driving apparatus includes a memory for storing digital data, a controller for calling the digital data to output the digital data together with a clock signal and at least one selection signal, and a gray voltage generator formed of an integrated circuit to receive the digital data from the controller and to generate gray reference voltage sets. The gray voltage generator includes first and second registers for storing the digital data, a selector including a plurality of multiplexers for receiving the outputs of the first and second registers, and a converter including a plurality of digital-analog converters connected to the multiplexers. As described above, the gray voltage generator is provided in the form of a chip so that it is possible to reduce the area occupied on a printed circuit board (PCB) and to reduce the cost of the gray voltage generator.

11 Claims, 12 Drawing Sheets

FOREIGN PATENT DOCUMENTS

| | | | |
|---|---|---|---|
| JP | 2003-280615 | A | 10/2003 |
| JP | 2004-201026 | | 7/2004 |
| JP | 2004-220021 | A | 8/2004 |
| JP | 2005-502093 | | 1/2005 |
| JP | 2005-316211 | A | 11/2005 |
| KR | 1020000000788 | | 1/2000 |
| KR | 1020000046538 | | 7/2000 |
| KR | 2002-0057800 | | 7/2002 |
| KR | 1020020056354 | | 7/2002 |
| KR | 1020030058201 | | 7/2003 |
| KR | 1020040015910 | | 2/2004 |
| KR | 1020040017480 | | 2/2004 |
| KR | 1020040052357 | | 6/2004 |
| KR | 1020040060708 | | 7/2004 |
| KR | 10-0465567 | | 12/2004 |
| KR | 1020050015035 | | 2/2005 |
| WO | 9809269 | | 3/1998 |
| WO | 2005038766 | A1 | 4/2005 |

* cited by examiner

DRIVING APPARATUS FOR DISPLAY DEVICE

This application claims priority to Korean Patent Application No. 10-2005-0065808, filed on Jul. 20, 2005, and all the benefits accruing therefrom under 35 U.S.C. §119, and the contents of which in its entirety are herein incorporated by reference.

BACKGROUND OF THE INVENTION (a) Field of the Invention

The present invention relates to a driving apparatus for a display device. More particularly, the present invention relates to a driving apparatus for a display device that costs less and occupies less area on a printed circuit PCB.

(b) Description of the Related Art

A liquid crystal display ("LCD") is one of the most widely used flat panel displays. The LCD is composed of two display panels on which field generating electrodes such as pixel electrodes and common electrodes are formed, and a liquid crystal layer interposed between the two display panels. A voltage is applied to the field generating electrodes to generate an electric field in the liquid crystal layer. The orientation of liquid crystal molecules of the liquid crystal layer is determined and the polarization of incident light is controlled through the generated electric field to display an image.

The LCD includes pixels including switching elements, display panels including display signal lines, a gray voltage generator for generating gray reference voltages, and a data driver for generating a plurality of gray voltages. The data driver uses the gray reference voltages to apply gray voltages corresponding to image signals among the generated gray voltages as data signals to data lines among the display signal lines.

Also, among the LCDs, a vertical alignment ("VA") mode LCD is used in which the longitudinal axes of the liquid crystal molecules are arranged to be perpendicular to the upper and lower display panels in a state where the electric field is not applied. The VA mode LCD is spotlighted since a large contrast ratio and a large reference viewing angle are easily implemented. Here, the reference viewing angle means a viewing angle at which the contrast ratio is 1:10 or a luminance inversion limiting angle among gray levels.

In order to implement an optical viewing angle in the VA mode LCD, a method of forming cutouts in the field generating electrodes and a method of forming protrusions on the field generating electrodes are used. Since the cutouts and the protrusions can determine the directions in which the liquid crystal molecules are inclined, the directions in which the liquid crystal molecules are inclined are dispersed into various directions using the cutouts and the protrusions to increase the reference viewing angle.

However, the VA mode LCD has a problem in that side visibility is inferior to front visibility. For example, in the case of a patterned vertically aligned ("PVA") mode LCD having cutouts, an image becomes brighter toward a side so that there is no difference in luminance among high gray levels in a severe case and the image looks crumbled.

In order to solve such a problem, each pixel is divided into two sub-pixels and the two sub-pixels are capacitively coupled to each other. A voltage is directly applied to one sub-pixel and a drop in voltage is caused in the other sub-pixel by the capacitive coupling to make the voltages of the two sub-pixels different from each other, and to thus make the transmittances of the two sub-pixels different from each other.

In order to make the transmittances of the two sub-pixels different from each other, data voltages applied to the two sub-pixels must be different from each other, which means that gray voltages applied to the two sub-pixels must be different from each other. The gray voltage generator generates the gray voltages, or the gray reference voltages, to be applied to the two sub-pixels. The gray voltage generator includes a resistor column, switching elements and operational amplifiers mounted on a printed circuit board ("PCB") together with other driving circuits. However, since the gray voltage generator is composed of separate parts, the gray voltage generator occupies a large area on the PCB and is also expensive.

Therefore a gray voltage generator that can be mounted in a reduced mounting area and having a lower cost is desired, as well as a display device including the gray voltage generator.

BRIEF SUMMARY OF THE INVENTION

According to an exemplary embodiment of the present invention, a driving apparatus for a display device includes a plurality of pixels arranged in a matrix, each pixel containing first and second sub-pixels, and the driving apparatus includes a memory for storing digital data, a controller for calling the digital data to output it together with a clock signal and at least one selection signal, and a gray voltage generator formed of an integrated circuit to receive the digital data from the controller and to generate gray reference voltage sets.

The gray voltage generator includes first and second registers for storing the digital data, a selector including a plurality of multiplexers for receiving the outputs of the first and second registers, and a converter including a plurality of digital-analog converters that are connected to the multiplexers.

A pair of outputs from the first and second registers, respectively, may be input to each of the multiplexers. The driving apparatus for a display device may further include buffers connected to respective digital-analog converters.

Also, the selection signals may be input to the multiplexers.

Unlike the above, at least two pairs of outputs from the first and second registers, respectively, may be input to each of at least some of the multiplexers. The driving apparatus for a display device may further include at least two sample and hold circuits that are connected to each of at least some of the digital-analog converters. Also, one of the selection signals is input to the multiplexers and the other selection signals are input to the sample and hold circuits.

The driving apparatus for a display device may further include a data driver for receiving the gray reference voltage sets to generate a plurality of gray voltages and for applying the gray voltages corresponding to image signals as data signals to the first and second sub-pixels.

According to another exemplary embodiment of the present invention, a driving apparatus for a display device includes a plurality of pixels arranged in a matrix, and each pixel includes first and second sub-pixels. The driving apparatus includes a memory for storing digital data, a controller for calling the digital data to output it together with a clock signal and at least one selection signal, and a gray voltage generator formed of an integrated circuit to receive the digital data from the controller and to generate gray reference voltage sets.

The gray voltage generator includes a resistor column for generating a plurality of first gray reference voltages, a register for storing the digital data, a converter including a plurality of digital-analog converters for receiving the outputs of the registers, and operational amplifiers connected to the resistor column and connected to the digital-analog converters, wherein the operational amplifiers are connected to the digital-analog converters through respective switching elements.

The selection signals may be input to the switching elements.

The gray voltage generator outputs the first gray reference voltages when the switching elements are turned off, and outputs second gray reference voltages when the switching elements are turned on. The second gray reference voltages are sums of the first gray reference voltages and the outputs of the respective digital-analog converters.

The driving apparatus for a display device may further include a data driver for receiving the gray reference voltage sets to generate a plurality of gray voltages and for applying the gray voltages corresponding to image signals as data signals to the first and second sub-pixels.

According to yet another exemplary embodiment of the present invention, a driving apparatus for a display device includes a plurality of pixels arranged in a matrix, and each pixel includes first and second sub-pixels. The driving apparatus includes a memory for storing digital data, a controller for calling the digital data to output the digital data together with a clock signal and at least one selection signal, and a gray voltage generator formed of an integrated circuit to receive the digital data from the controller and to generate gray reference voltage sets.

The gray voltage generator includes first and second resistor column sets, each with a resistor column, first and second decoders connected to the first and the second resistor column sets, respectively, and a selector including a plurality of multiplexers for receiving the outputs of the first and second decoders.

At this time, the digital data may be input to the first and second decoders.

Also, the first and second decoders may each include a selector connected to a respective resistor column for dividing a predetermined voltage to generate a plurality of analog voltages, and for selecting one of the analog voltages in accordance with the digital data to output the selected one.

The selection signals may be input to the multiplexers of the selector.

The driving apparatus for a display device may further include a data driver for receiving the gray reference voltage sets to generate a plurality of gray voltages and for applying the gray voltages corresponding to image signals to the first and second sub-pixels.

According to still another exemplary embodiment of the present invention, a driving apparatus for a display device includes a plurality of pixels arranged in a matrix, and each pixel has first and second sub-pixels. The driving apparatus includes a memory for storing digital data, a controller for calling the digital data to output the digital data together with a clock signal and at least one selection signal, and a gray voltage generator formed of an integrated circuit to receive the digital data from the controller and to generate gray reference voltage sets.

The gray voltage generator includes first and second registers for receiving the digital data, a converter including first and second digital-analog converters connected to the first and second registers, respectively, first and second sustainers each including a plurality of sample and hold circuits connected to the first and second digital-analog converters, and a selector including a plurality of multiplexers for receiving the outputs of the first and second sustainers.

At this time, two of the selection signals may be input to a corresponding sustainer of the first and second sustainers and one of the selection signals may be input to the multiplexers of the selector.

The driving apparatus for a display device may further include a data driver for receiving the gray reference voltage sets to generate a plurality of gray voltages and for applying the gray voltages corresponding to image signals to the first and second sub-pixels and may include buffers connected to respective multiplexers of the selector.

BRIEF DESCRIPTION OF THE DRAWINGS

The above and other features and advantages of the present invention will become more apparent by describing exemplary embodiments thereof with reference to the accompanying drawings, in which.

DETAILED DESCRIPTION OF THE INVENTION

Figure 1:
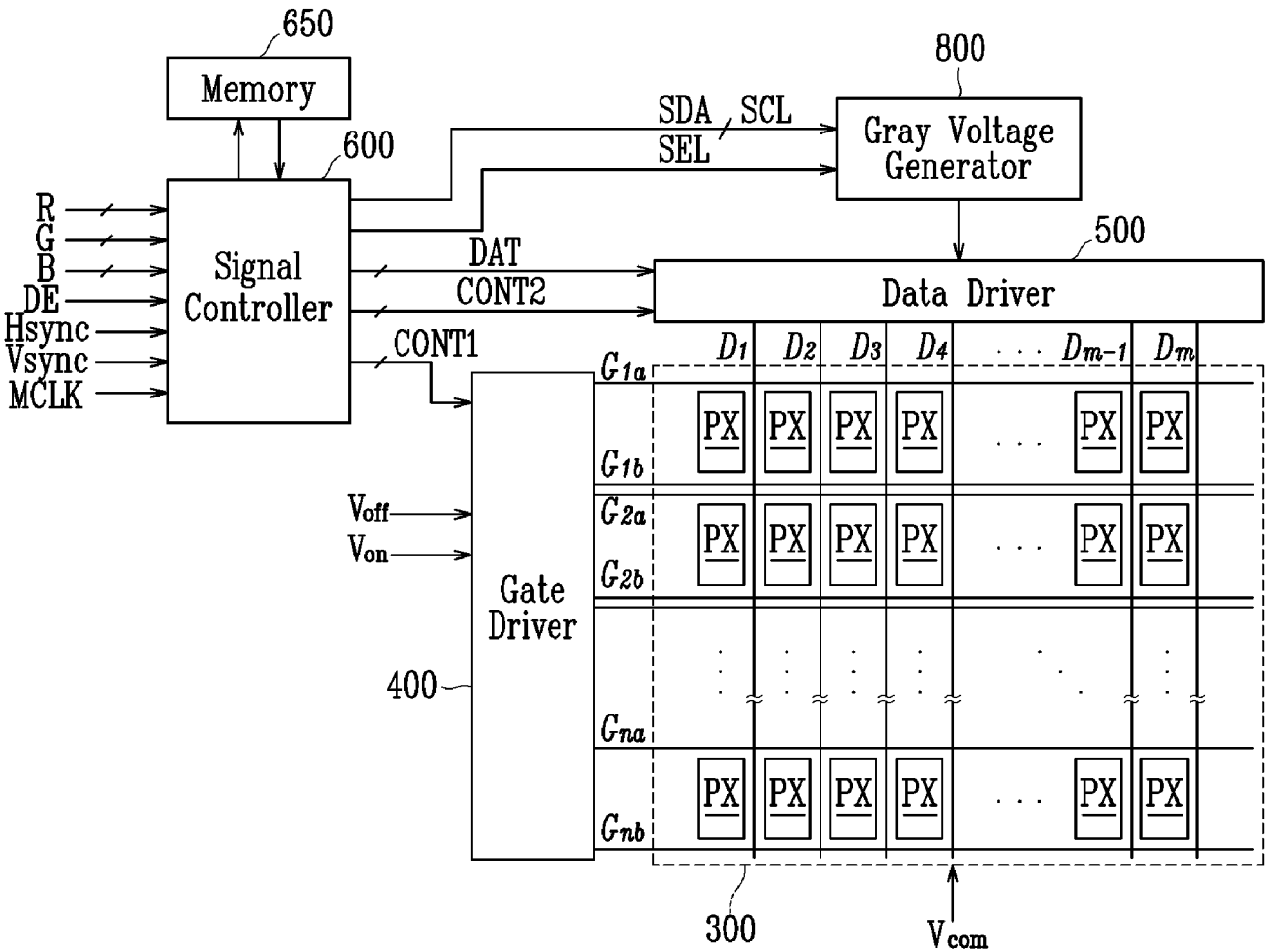
FIG. 1 is a block diagram of an exemplary liquid crystal display ("LCD") according to an exemplary embodiment of the present invention.

With reference to the accompanying drawings, the present invention will be described in order for those skilled in the art to be able to implement the invention. As those skilled in the art would realize, the described embodiments may be modified in various different ways, all without departing from the spirit or scope of the present invention. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

A gray voltage generator according to an exemplary embodiment of the present invention and a display device including the gray voltage generator will be described with reference to the drawings, and a liquid crystal display ("LCD") will be described as an example.

Figure 2A:
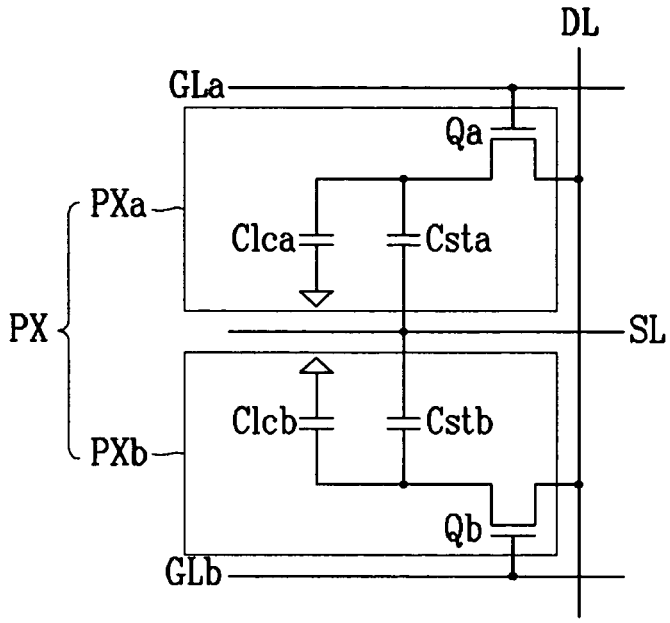
FIG. 2A and FIG. 2B are equivalent circuit schematic diagrams of one pixel of the LCD according to an exemplary embodiment of the present invention.
Figure 2B:
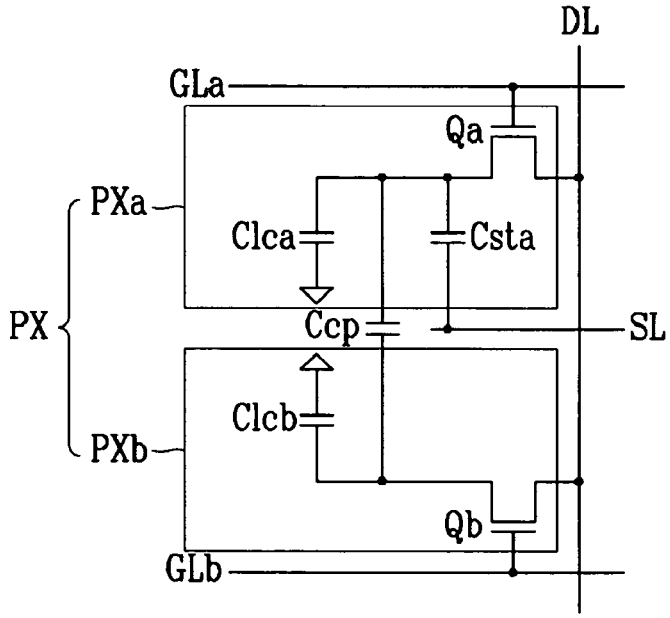
Figure 3:
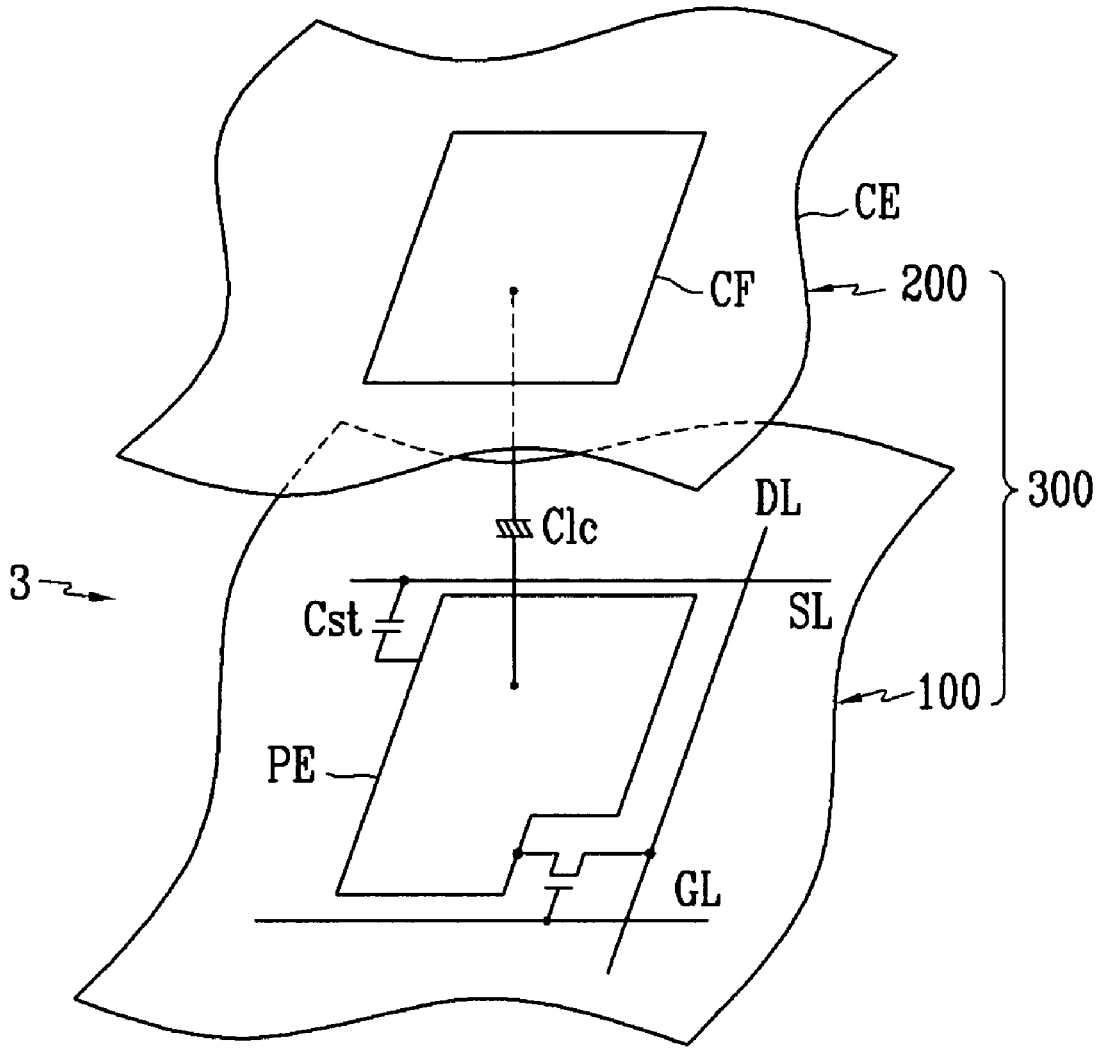
FIG. 3 is an equivalent circuit schematic diagram of one sub-pixel of the LCD according to an exemplary embodiment of the present invention.

FIG. 1 is a block diagram of an exemplary LCD according to an exemplary embodiment of the present invention. FIG. 2A and FIG. 2B are equivalent circuit schematic diagrams of one pixel of the LCD according to an exemplary embodiment of the present invention. FIG. 3 is an equivalent circuit schematic diagram of one sub-pixel of the LCD according to an exemplary embodiment of the present invention.

Referring to FIG. 1, the LCD according to an exemplary embodiment of the present invention includes a liquid crystal panel assembly 300, a gate driver 400 and a data driver 500 connected to the liquid crystal panel assembly 300, a gray voltage generator 800 connected to the data driver 500, and a signal controller 600 for controlling the liquid crystal panel assembly 300, the gate driver 400, the data driver 500 and the gray voltage generator 800.

In an equivalent circuit, the liquid crystal panel assembly 300 includes a plurality of display signal lines and a plurality of pixels PX connected to the display signal lines and arranged basically in a matrix. Referring to FIG. 3, the structure of the liquid crystal panel assembly 300 includes lower and upper panels 100 and 200 that face each other and a liquid crystal layer 3 interposed between the lower and upper panels 100 and 200.

The display signal lines are provided on the lower panel 100 and include a plurality of gate lines $G_{1a}$-$G_{nb}$ for transmitting gate signals (referred to as "scanning signals") and data lines $D_1$-$D_m$ for transmitting data signals. The gate lines $G_{1a}$-$G_{nb}$ extend basically in a row direction to run almost parallel to each other, and the data lines $D_1$-$D_m$ extend basically in a column direction to run almost parallel to each other, as illustrated in FIG. 1.

Equivalent circuits of the display signal lines and a respective pixel are illustrated in FIG. 2A and FIG. 2B. The display signal lines includes a storage electrode line SL that runs almost parallel to the gate lines $G_{1a}$-$G_{nb}$, other than the gate lines denoted by reference characters GLa and GLb and the data line denoted by reference character DL.

Referring to FIG. 2A, each pixel PX includes a pair of sub-pixels PXa and PXb. The sub-pixels PXa and PXb include switching elements Qa and Qb, respectively, connected to the corresponding gate lines GLa and GLb and the data line DL, liquid crystal capacitors Clca and Clcb connected to the switching elements Qa and Qb, respectively, and storage capacitors Csta and Cstb connected to the switching elements Qa and Qb, respectively, and the storage electrode line SL. The storage capacitors Csta and Cstb can be omitted if necessary, in which case, the storage electrode line SL is also not required.

Referring to FIG. 2B, the pixel PX includes the pair of sub-pixels PXa and PXb and a coupling capacitor Ccp connected therebetween. The sub-pixels Pxa and PXb include the switching elements Qa and Qb connected to the corresponding gate lines GLa and GLb, respectively, and the data line DL and the liquid crystal capacitors Clca and Clcb connected to the switching elements Qa and Qb, respectively. One pixel PXa between the two sub-pixels PXa and PXb includes the storage capacitor Csta connected to the switching element Qa and the storage electrode line SL.

Referring to FIG. 3, the switching element Q of each of the sub-pixels PXa and PXb is formed of a thin film transistor ("TFT") provided on the lower panel 100 and is a three-terminal element having a control terminal connected to the gate line GL, an input terminal connected to the data line DL and an output terminal connected to the liquid crystal capacitor Clc and the storage capacitor Cst.

The liquid crystal capacitor Clc uses a sub-pixel electrode PE of the lower panel 100 and a common electrode CE of the upper panel 200 as two terminals. The liquid crystal layer 3 between the two electrodes PE and CE operates as a dielectric material. The sub-pixel electrode PE is connected to the switching element Q, and the common electrode CE is provided on the entire surface of the upper panel 200 to receive a common voltage Vcom. Unlike in FIG. 3, the common electrode CE may be provided on the lower panel 100, in which case at least one of the two electrodes PE and CE may be linear or bar-shaped.

The storage electrode line SL and the pixel electrode PE provided on the lower panel 100 overlap each other with an insulator interposed therebetween to obtain the storage capacitor Cst that supplements the liquid crystal capacitor Clc, and a predetermined voltage, such as the common voltage Vcom, is applied to the storage electrode line SL. However, the sub-pixel electrode PE may overlap a previous gate line with the insulator interposed therebetween to obtain the storage capacitor Cst in alternative exemplary embodiments.

In order to display a color, each pixel uniquely displays one of three colors (spatial division) or alternately displays the three colors in accordance with time (temporal division) so that a desired color is recognized by the spatial and temporal sum of the three colors. The three colors are red, green and blue, and may include primary colors. FIG. 3 illustrates an example of the spatial division in which each pixel includes a color filter CF that represents one of the colors in the region of the upper panel 200. Unlike in FIG. 3, the color filter CF may be provided on or under the sub-pixel electrode PE of the lower panel 100 in alternative exemplary embodiments.

Referring to FIG. 1, the gate driver 400 is connected to the gate lines $G_{1a}$-$G_{nb}$ to apply a gate signal obtained by the composition of gate-on voltage Von and gate-off voltage Voff from the outside (e.g., external device not shown).

The gray voltage generator 800 is connected in an $I^2C$ interface method to receive data SDA and a clock signal SCL and to thus generate two gray reference voltage sets related to the transmittance of the pixel. The two gray reference voltage sets are independently provided to the two sub-pixels that constitute one pixel, and have positive and negative values for the common voltage Vcom. However, only one gray reference voltage set may be generated instead of the two reference gray voltage sets.

A memory 650 connected to the signal controller 600 stores digital data on the gray reference voltage and outputs the stored digital data to the signal controller 600.

The data driver 500 connected to the data lines $D_1$-$D_m$ of the liquid crystal panel assembly 300 divides the gray reference voltage from the gray voltage generator 800, generates gray voltages for the entire gray levels, and selects data voltages from among the gray voltages.

The signal controller 600 controls the operations of the gate driver 400 and the data driver 500.

The driving apparatuses 400, 500, 600 and 800 may be directly mounted on the liquid crystal panel assembly 300 in the form of at least one integrated circuit ("IC") chip, may be mounted on a flexible printed circuit film (not shown) to be attached to the liquid crystal panel assembly 300 in the form of a tape carrier package ("TCP"), or may be mounted on an additional printed circuit board ("PCB") (not shown). Unlike the above, the driving apparatuses 400, 500, 600 and 800 may be integrated with the liquid crystal panel assembly 300 together with the signal lines $G_{1a}$-$G_{nb}$ and $D_1$-$D_m$ and the TFT switching elements Qa and Qb. Also, the driving apparatuses 400, 500, 600 and 800 may be integrated into a single chip. In this case, at least one of the driving apparatuses 400, 500, 600 and 800 or at least one circuit that forms the driving apparatuses 400, 500, 600 and 800 may be provided outside the single chip.

The display operation of the LCD will now be described below.

The signal controller 600 receives input image signals R, G and B and input control signals for controlling the display of the input image signals R, G and B such as a vertical synchronizing signal Vsync, a horizontal synchronizing signal Hsync, a main clock signal MCLK and a data enable signal DE from an external graphics controller (not shown). After the image signals R, G and B are properly processed to be suitable for the operating condition of the liquid crystal panel assembly 300, and a gate control signal CONT1 and a data control signal CONT2 are generated based on the input image signals R, G and B and the input control signals of the signal controller 600, the gate control signal CONT1 is output to the gate driver 400, the data control signal CONT2 and the processed image signals DAT are output to the data driver 500, and a selection signal SEL for controlling the gray voltage generator 800 is generated to be output.

The gate control signal CONT1 includes a scanning start signal STV for indicating to start scanning and a clock signal CPV for controlling the output time of the gate-on voltage Von.

The data control signal CONT2 includes a horizontal synchronization start signal STH for informing of the transmission of data on a batch of pixels PX, and a load signal LOAD and a data clock signal HCLK for applying the corresponding data voltages to the data lines $D_1$-$D_m$. The data control signal CONT2 may include an inversion signal RVS for inverting the polarity of data voltage on the common voltage Vcom (hereinafter, the polarity of the data voltage on the common voltage will be referred to as the polarity of the data voltage).

The selection signal SEL is for selecting one of the two gray reference voltage sets generated by the gray voltage generator 800, and has a period equal to the periods of the horizontal synchronization start signal STH and a load signal TP. On the other hand, the period of the clock signal of the gate control signal CONT1 may be twice the period of the horizontal synchronization start signal STH. In this case, the clock signal may be used as the selection signal SEL.

In accordance with the data control signal CONT2 from the signal controller 600, the data driver 500 receives the digital image data signals DAT on the batch of sub-pixels PX and selects gray voltages corresponding to the respective digital image data signals DAT to convert the digital image data signals DAT into analog data signals and to apply the converted analog data signals to the corresponding data lines $D_1$-$D_m$.

The gate driver 400 applies the gate-on voltage Von to the gate lines $G_{1a}$-$G_{nb}$, in accordance with the gate control signal CONT1 from the signal controller 600, to turn on the switching elements Qa and Qb connected to the gate lines $G_{1a}$-$G_{nb}$ so that the data voltages applied to the data lines $D_1$-$D_m$ are applied to the corresponding sub-pixels PXa and PXb through the turned on switching elements Qa and Qb.

A difference between the data voltages applied to the sub-pixels PXa and PXb and the common voltage Vcom is the charge voltage of the liquid crystal capacitor Clc, that is, a pixel voltage. The arrangement of the liquid crystal molecules varies with the magnitude of the pixel voltage so that the polarization of the light that passes through the liquid crystal layer 3 changes. The change in the polarization causes a change in transmittance of light by polarizers (not shown) attached to the display panels 100 and 200.

The data driver 500 and the gate driver 400 repeat the same operations in units of a ½ horizontal period (or "½ H") (one period of the horizontal synchronizing signal Hsync and a gate clock (CPV)). In such a method, the gate-on voltage Von is sequentially applied to all of the gate lines $G_{1a}$-$G_{nb}$ in one frame to apply the data voltages to all of the pixels. The state of the inversion signal RVS applied to the data driver 500 is controlled so that when one frame ends the next frame starts, and the polarities of the data voltages applied to the respective pixels are opposite to the polarities in the previous frame ("frame inversion"). At this time, the polarity of the data voltage that flows through one data line may change (examples: row inversion and dot inversion) or the polarities of the data voltages that simultaneously flow through adjacent data lines may be different from each other (examples: column inversion and dot inversion) in one frame in accordance with the characteristic of the inversion signal RVS.

Exemplary embodiments of the gray voltage generator according to an exemplary embodiment of the present invention will now be described in detail with reference to FIG. 4 to FIG. 10.

Figure 4:
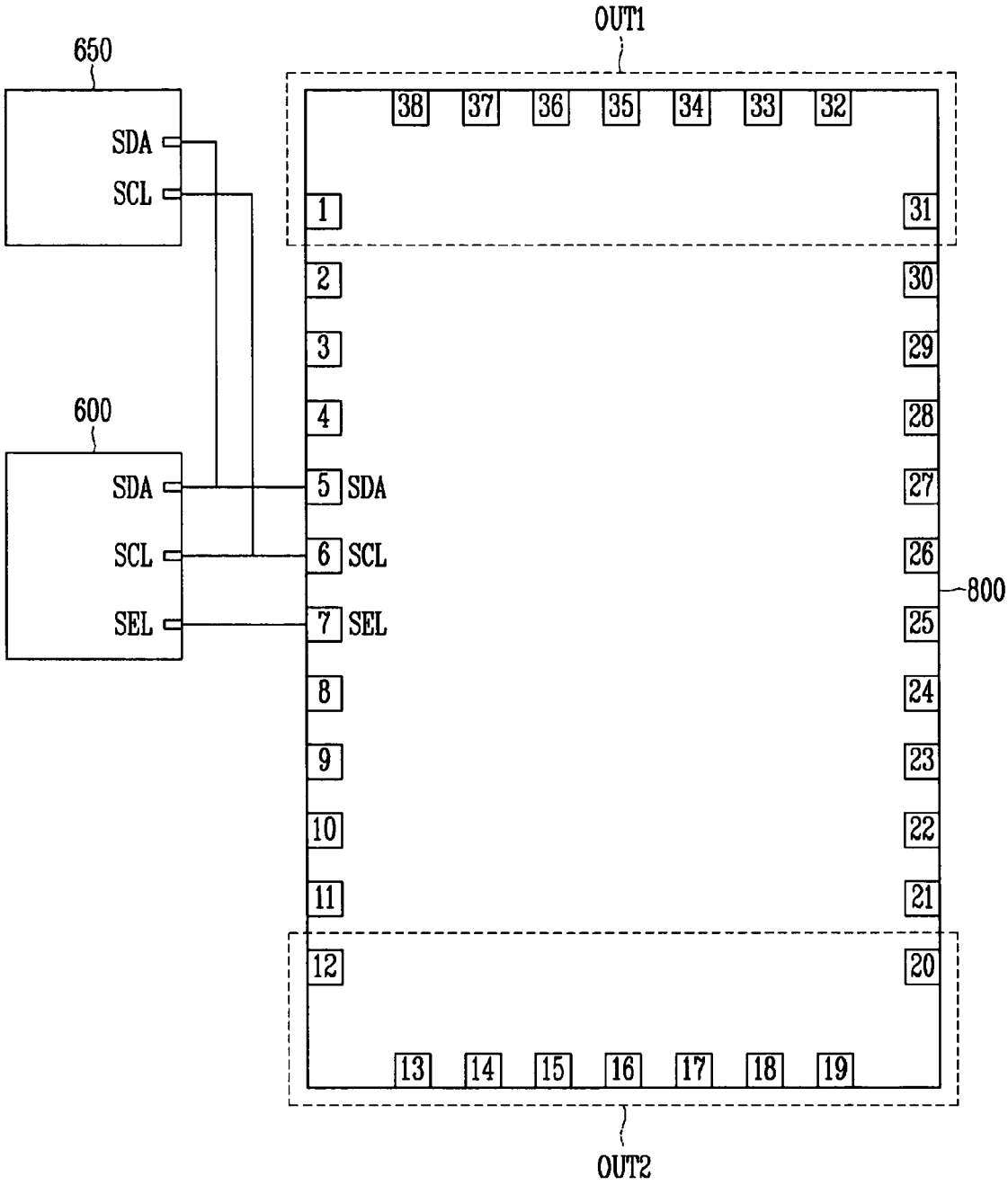
FIG. 4 is a block diagram of an exemplary driving apparatus for the LCD according to an exemplary embodiment of the present invention.
Figure 5:
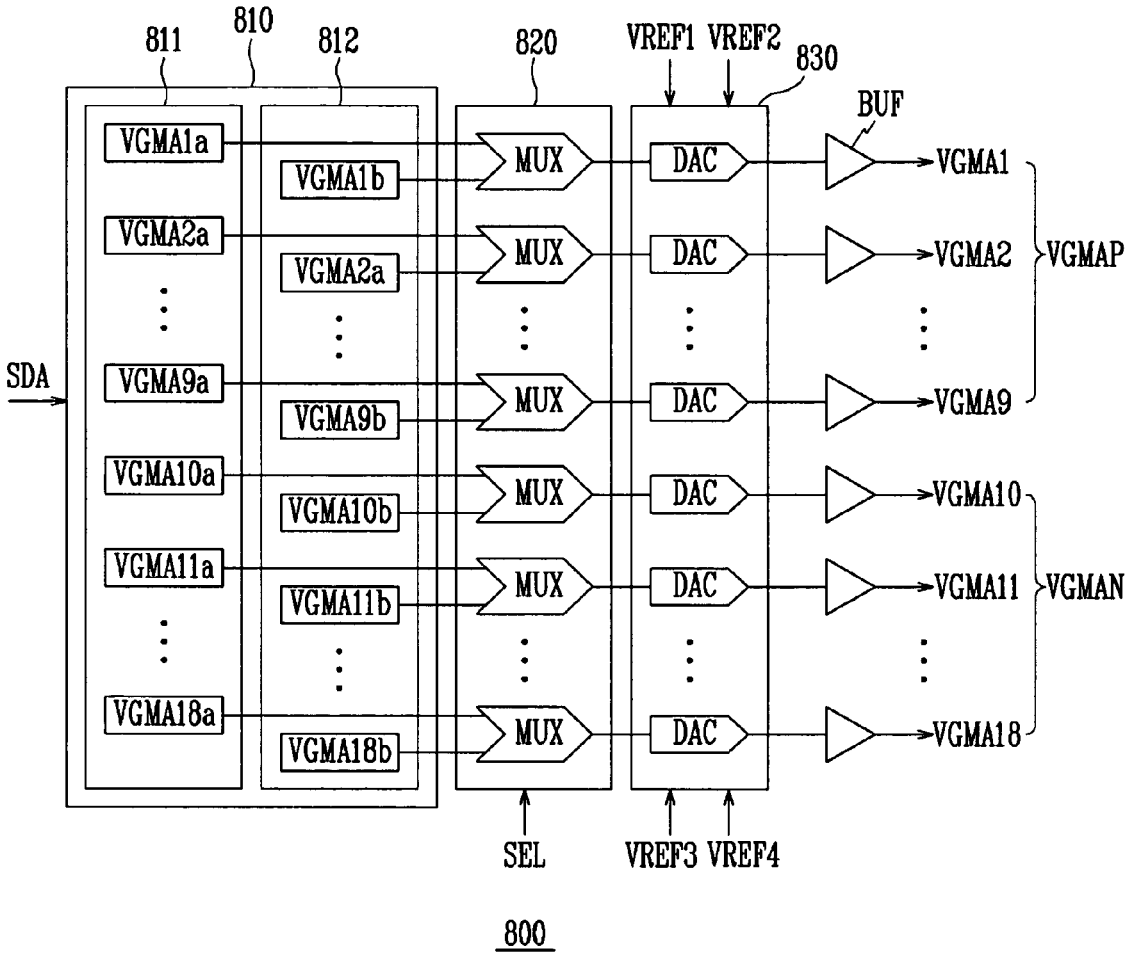
FIG. 5 is a block diagram of an exemplary gray voltage generator according to an exemplary embodiment of the present invention.
Figure 6:
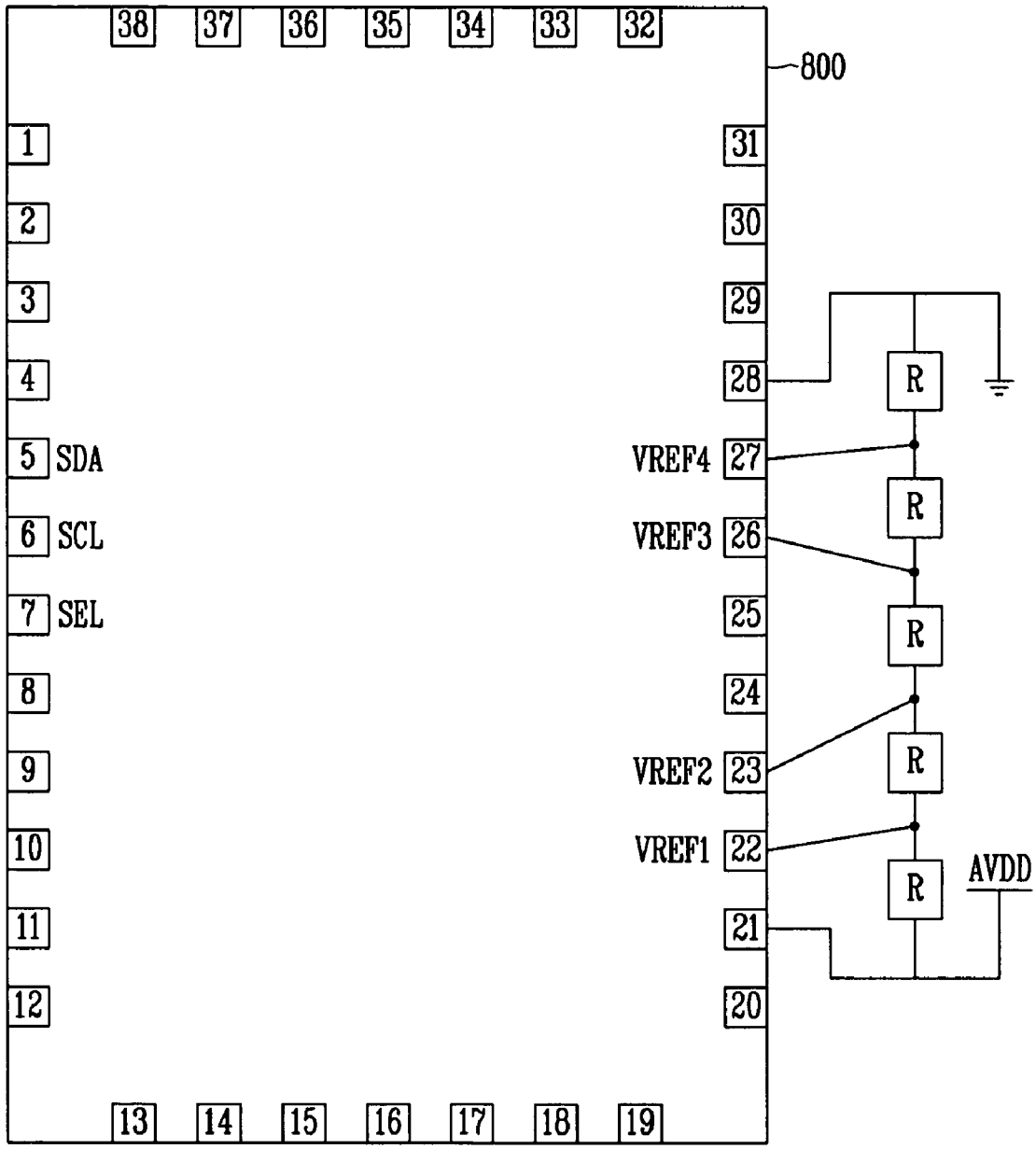
FIG. 6 is a block diagram illustrating an example in which a reference voltage is applied to the gray voltage generator according to an exemplary embodiment of the present invention.

FIG. 4 is a block diagram of an exemplary driving apparatus for the LCD according to an exemplary embodiment of the present invention. FIG. 5 is a block diagram of the gray voltage generator according to an exemplary embodiment of the present invention. FIG. 6 is a block diagram illustrating an example in which a reference voltage is applied to the gray voltage generator according to an exemplary embodiment of the present invention.

Referring to FIG. 4, the gray voltage generator 800 according to an exemplary embodiment of the present invention is implemented in one chip in the form of an integrated circuit ("IC"), and has thirty eight (38) pins that are numbered from 1 to 38 as illustrated in the drawing. Among the pins, the nine pins 1 and 32 to 38 and the nine pins 12 to 20 form output units OUT1 and OUT2, respectively, and the data SDA, the clock signal SCL and the selection signal SEL are input to the three pins 5 to 7, respectively.

Also, as described above, the memory 650 stores the digital data SDA on the gray reference voltage to output data to the signal controller 600 by the call of the signal controller 600, and the signal controller 600 receives the data SDA to output the received data to the gray voltage generator 800.

Referring to FIG. 5, the gray voltage generator 800 according to an exemplary embodiment of the present invention includes a register 810 including a pair of digital registers 811 and 812, a data selector 820 including a plurality of multiplexers MUX connected to the digital registers 811 and 812, a converter 830 including a plurality of digital-analog converters ("DAC") connected to the multiplexers MUX, and buffers BUF connected to the DACs.

The two digital registers 811 and 812 store different digital gray reference data sets VGMA1*a*-VGMA18*a* and VGMA1*b*-VGMA18*b*, and the two gray reference data sets VGMA1*a*-VGMA18*a* and VGMA1*b*-VGMA18*b* correspond to each other to make pairs.

Each of the multiplexers MUX receives a pair of data VGMA1*a*ωVGMA1*b*, . . . , VGMA18*a*ωVGMA18*b* that correspond to each other from the respective two digital registers 811 and 812 to select one of the two data and to output the selected one in accordance with the selection signal SEL.

The DACs and the buffers BUF convert the digital data from the multiplexers MUX into analog voltages VGMA1-VGMA18 to amplify the analog voltages VGMA1-VGMA18 and to output the amplified analog voltages VGMA1-VGMA18. Hereinafter, an example will be illustrated in which eighteen positive and negative analog voltages VGMAP and VGMAN that are composed of nine positive analog voltages VGMAP and nine negative analog voltages VGMAN are generated. The number of analog voltages may vary in accordance with the input digital data SDA.

At this time, as illustrated in FIG. 6, a resistor column to which a plurality of resistors R connected between a driving voltage AVDD and a ground voltage is provided outside the gray voltage generator 800. The resistor column divides the driving voltage AVDD to provide reference voltages VREF1 to VREF4 that are input to the DACs. For example, the reference voltages VREF1 and VREF2 may have positive values for the common voltage Vcom and the reference voltages VREF3 and VREF4 may have negative values for the common voltage Vcom. Unlike the above, a resistor column may be provided in the gray voltage generator 800 to provide the reference voltages rather than being provided externally.

Figure 7:
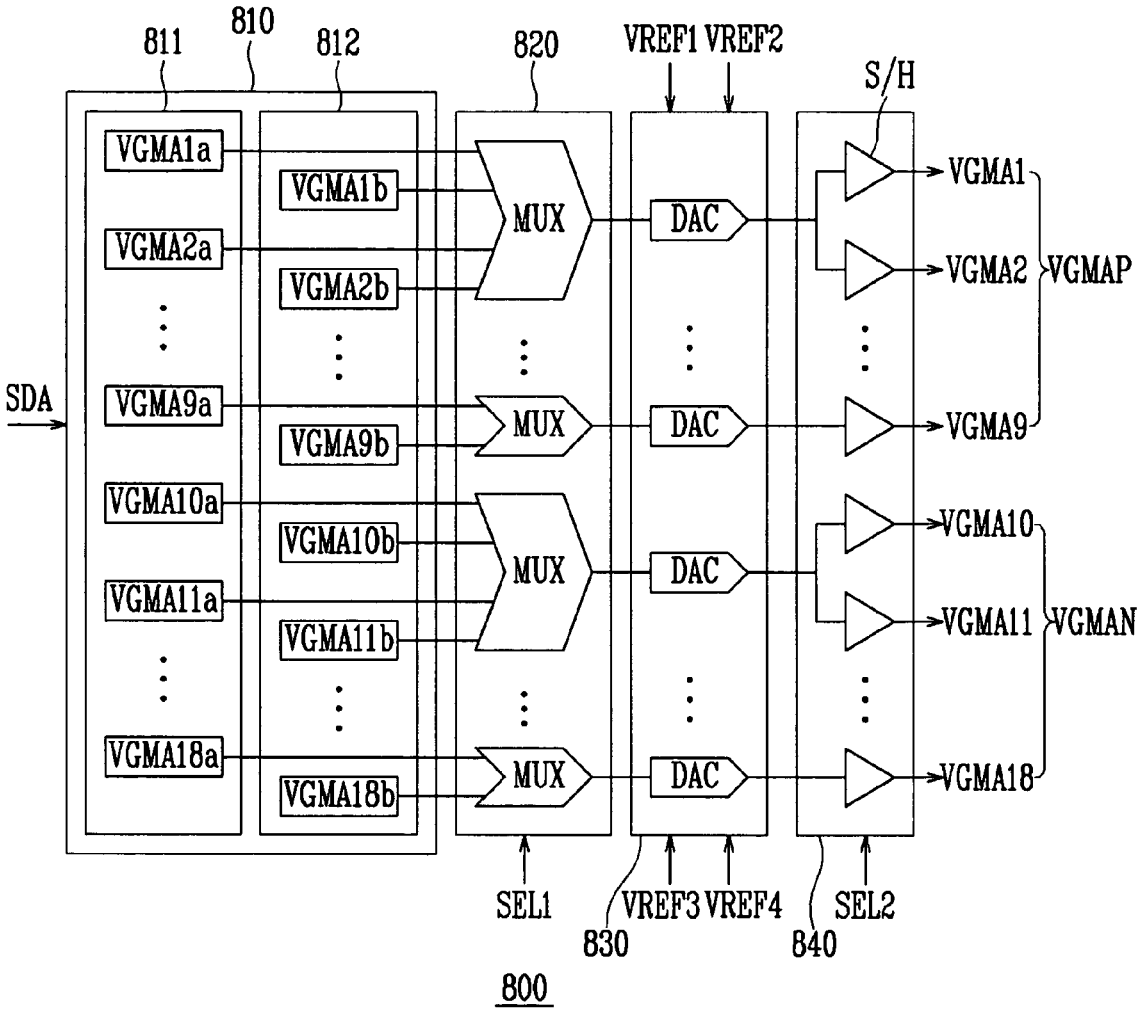
FIG. 7 is a block diagram of another exemplary gray voltage generator according to another exemplary embodiment of the present invention.

Referring to FIG. 7, the gray voltage generator 800 according to another exemplary embodiment of the present invention is illustrated that is almost the same as the gray voltage generator 800 illustrated in FIG. 5. That is, the gray voltage generator 800 includes the register 810 including the pair of digital registers 811 and 812, the data selector 820 including the plurality of multiplexers MUX connected to the digital registers 811 and 812, and the converter 830 including the plurality of DACs connected to the multiplexers MUX. However, either two pairs of data or a pair of data are input to the multiplexers MUX of the converter 830 rather than a single pair of data to each multiplexer MUX as in FIG. 5. Here, when the two pairs of data are input by polarity, a pair of data is input in the case of data VGMA9*a*ωVGMA9*b* and VGMA18*a*ωVGMA18*b*. Unlike the above, the two pairs of data may be input regardless of polarity. For example, data VGMA9*a*ωVGMA9*b* and VGMA10*a*ωVGMA10*b* may make pairs to be input to one multiplexer MUX. However, two or more pairs of data may be input.

According to such a method, it is possible to reduce the number of multiplexers MUX and DACs compared with the gray voltage generator 800 illustrated in FIG. 5.

In the present exemplary embodiment, one or two sample and hold circuits SH are connected to each single DAC. A selection signal SEL1 is input to the multiplexers MUX and a selection signal SEL2 is input to the sample and hold circuits SH. Since two different pairs of analog outputs are output through one DAC, the sample and hold circuits SH finally separate the pairs of analog outputs. The sample and hold circuits SH may be considered as combinations of the buffers BUF and the switching elements.

Figure 8A:
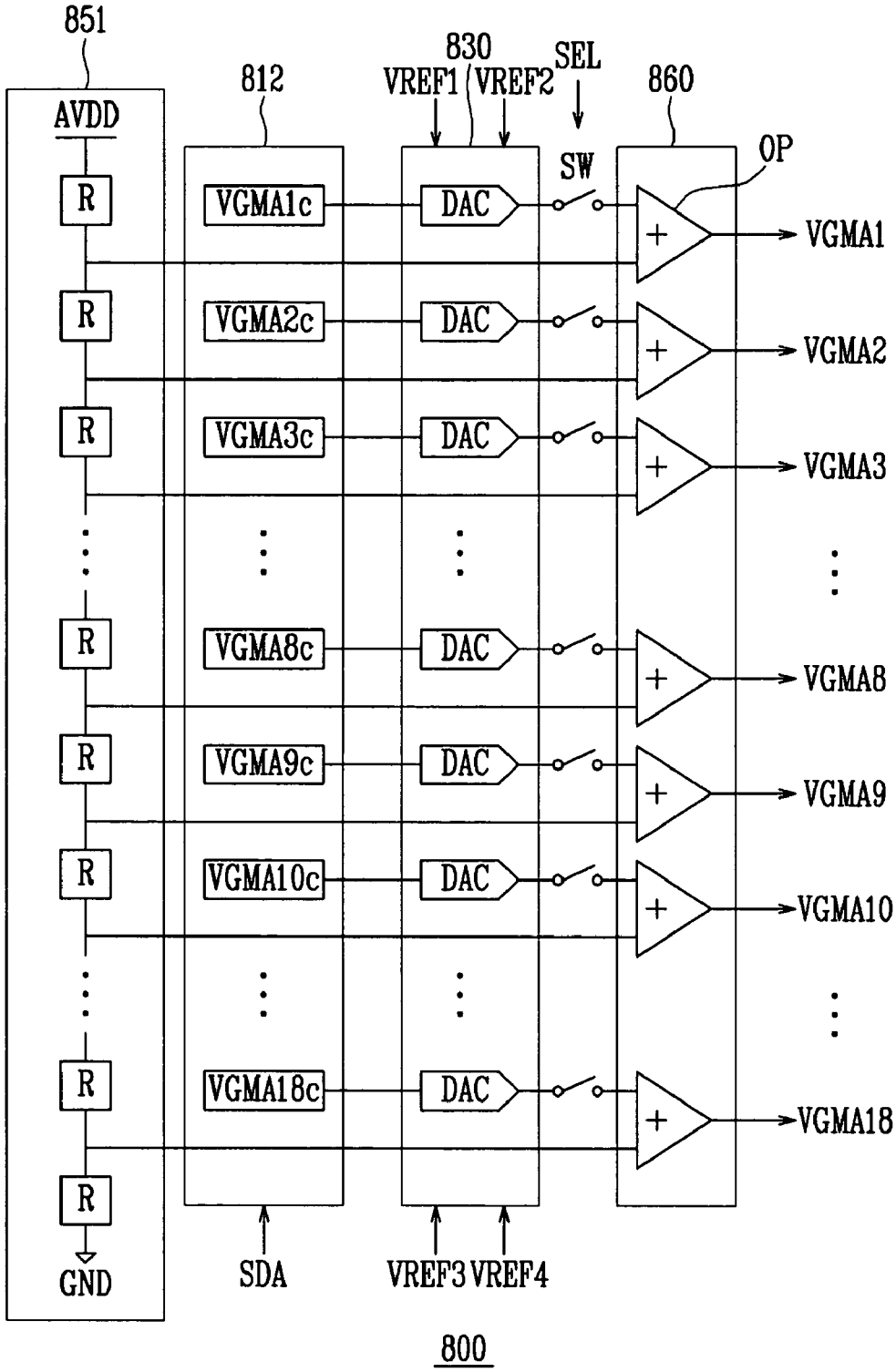
FIG. 8A is a block diagram of the gray voltage generator according to another exemplary embodiment of the present invention.
Figure 8B:
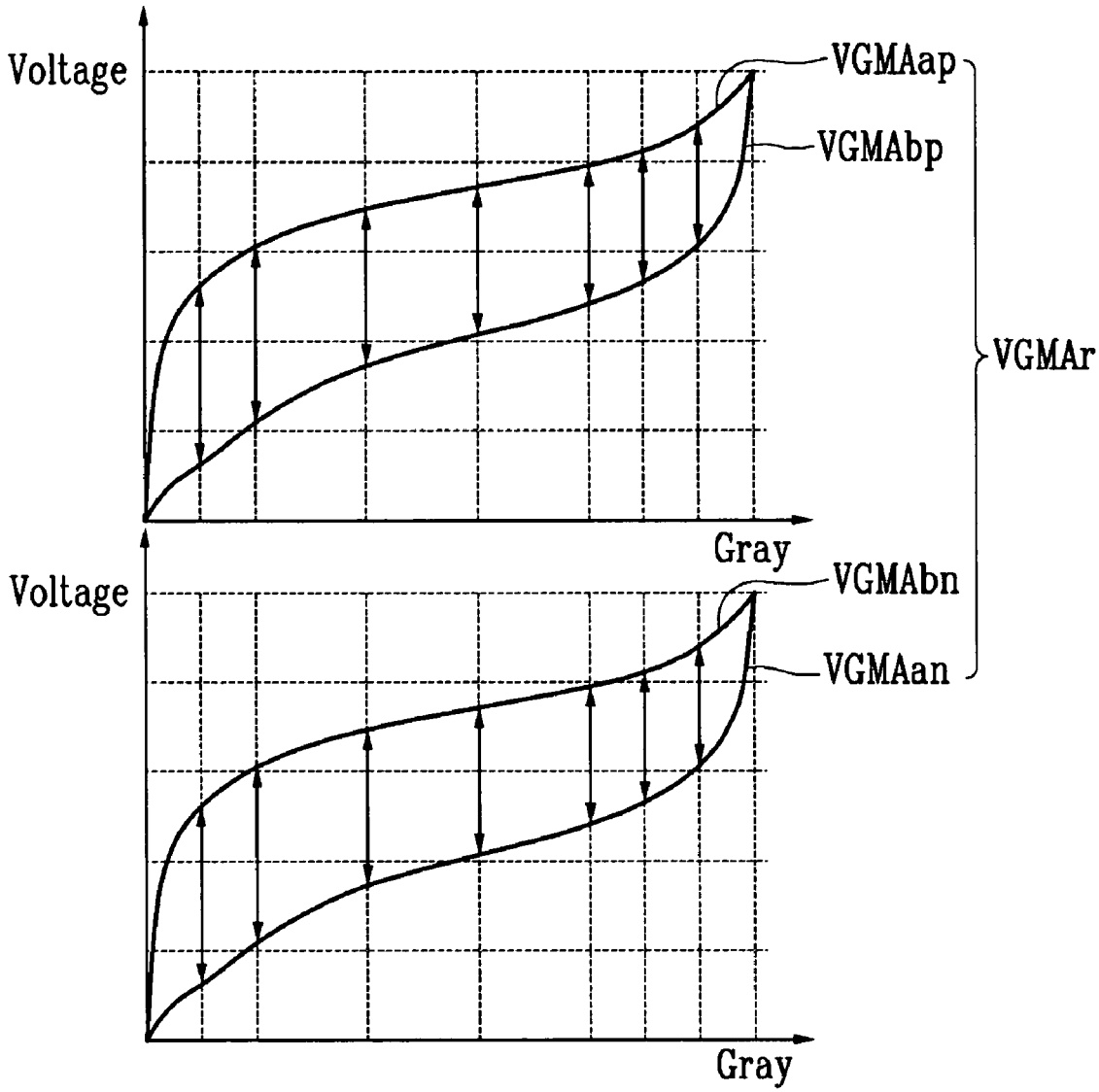
FIG. 8B is a graph illustrating voltages in accordance with gray levels that are generated by the gray voltage generator illustrated in FIG. 8A.

Referring to FIG. 8A and FIG. 8B, the gray voltage generator 800 according to another exemplary embodiment of the present invention includes a voltage generator 851 including a plurality of resistors R connected between the driving voltage AVDD and the ground voltage GND to generate analog gray reference voltages, the digital register 812 storing a plurality of digital data VGMA1*c*-VGMA18*c*, the converter 830 including the plurality of DACs connected to the digital register 812, and an operator 860 including operational amplifiers OP connected between the resistors R of the voltage generator 851 and to the DACs through switching elements SW.

Here, depending on the operation of the switching elements SW, the operational amplifiers OP either output only the voltages from the voltage generator 851 or output sums of the voltages from the voltage generator 851 and the outputs from the DACs. That is, when the switching elements SW are turned off so that only the voltage generated by the voltage generator 851 is output, analog gray reference voltages VGMAp and VGMAn are generated as illustrated in FIG. 8B. When the switching elements SW are turned on, analog gray reference voltages VGMAbp and VGMAbn are obtained and generated by adding the voltages from the DACs and the analog gray reference voltages VGMAp and VGMAn to each other. In FIG. 8B, an example in which differences represented by arrows are added to each other to generate the analog gray reference voltages VGMAbp and VGMAbn applied to the sub-pixel PXb is illustrated.

Figure 9A:
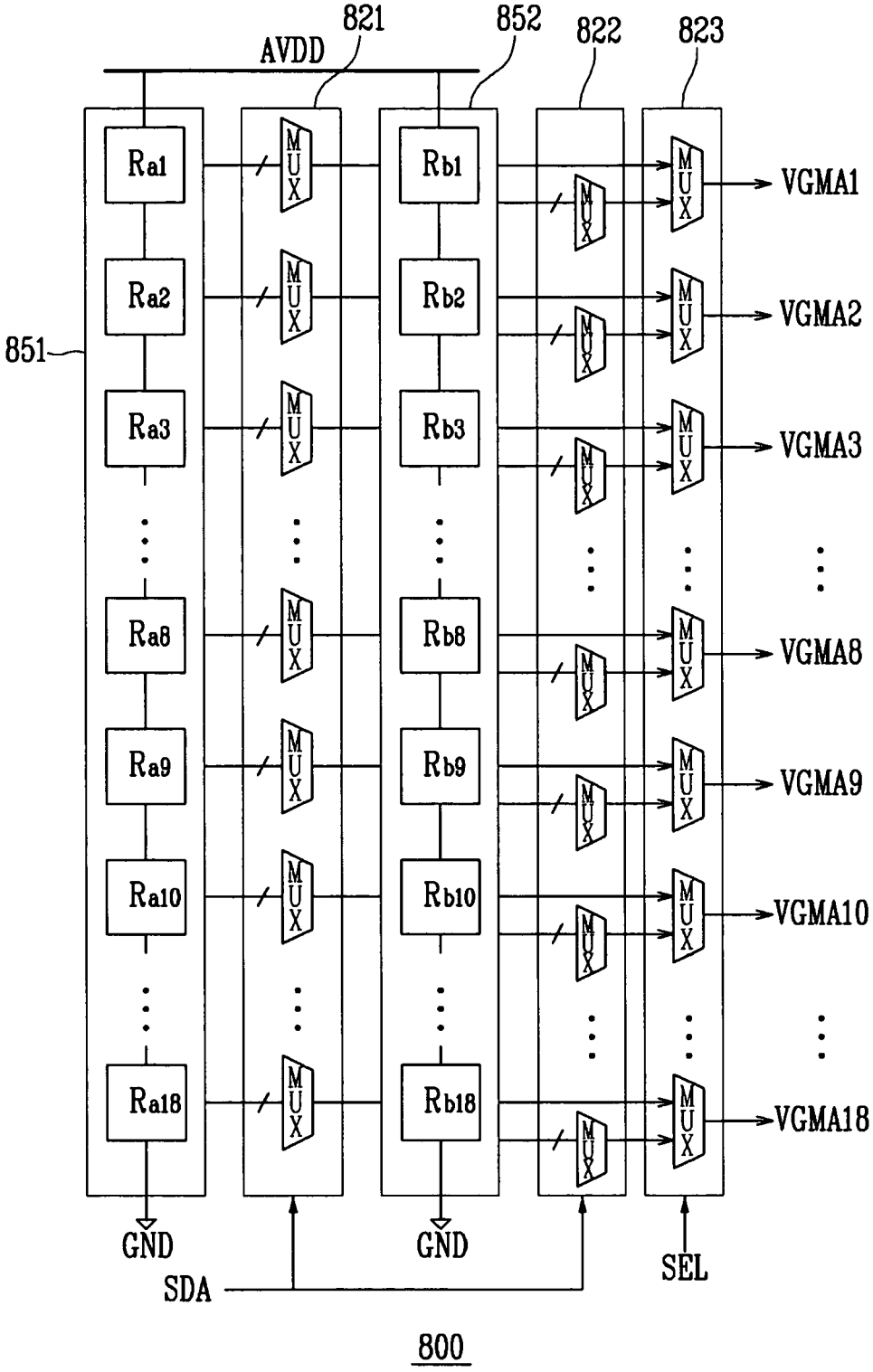
FIG. 9A is a block diagram of yet another exemplary gray voltage generator according to yet another exemplary embodiment of the present invention.
Figure 9B:
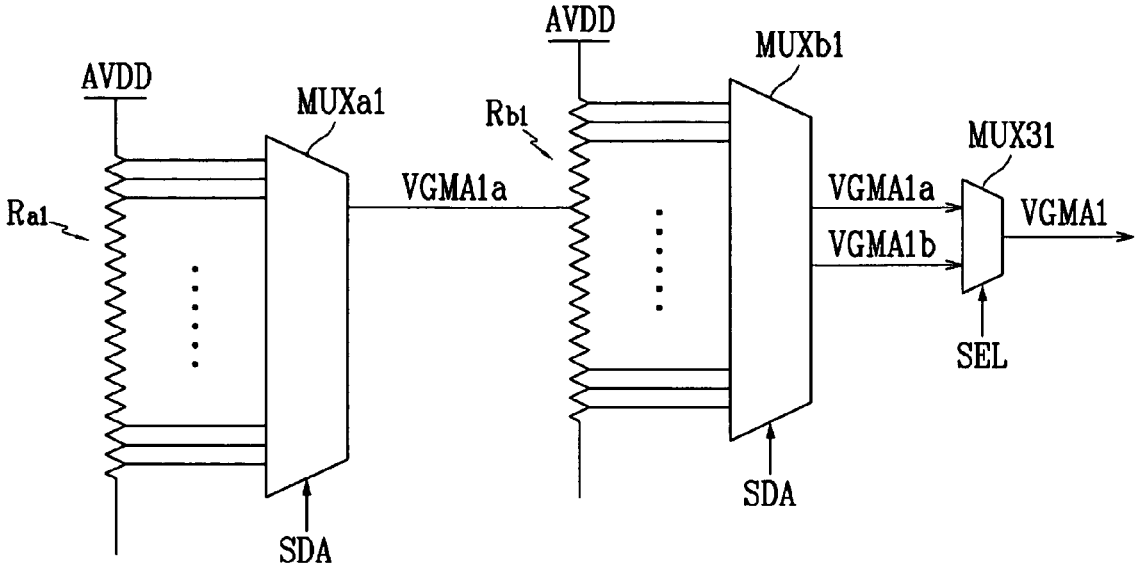
FIG. 9B is an enlarged partial view of FIG. 9A illustrating a resistor and selector.

FIG. 9A is a block diagram illustrating the gray voltage generator 800 according to yet another exemplary embodiment of the present invention. FIG. 9B is an enlarged view illustrating a part of the gray voltage generator 800 of FIG. 9A.

Referring to FIG. 9A and FIG. 9B, the gray voltage generator 800 according to another exemplary embodiment of the present invention includes a first voltage generator 851 including resistor column sets Ra1-Ra18, a first decoder 821 including multiplexers MUX connected to the first voltage generator 851, a second voltage generator 852 including resistor column sets Rb1-Rb18, a second decoder 822 including the multiplexers MUX connected to the second voltage generator 852, and a converter 823 including a plurality of multiplexers MUX connected to the multiplexers MUX of the first and second decoders 821 and 822.

Among the resistor column sets Ra1-Ra18 and Rb1-Rb18, for example referring to FIG. 9B, the resistor columns Ra1 and Rb1 generate gray reference voltages corresponding to the number of bits of the digital data SDA. For example, when the digital data SDA has eight bits, each of the resistor columns Ra1 and Rb1 generates 256 voltages and the digital data SDA selects one of the 256 generated voltages like the selection signal SEL. Therefore, the multiplexer MUX31 of the selector 823 outputs one of the pair of gray reference voltages VGMA1*a* and VGMA1*b* in accordance with the selection signal SEL.

The gray voltage generator 800 illustrated in FIG. 9A and FIG. 9B may be implemented by the resistor column sets Ra1-Ra18 and Rb1-Rb18 and the multiplexers MUX having simple circuit structures.

Figure 10:
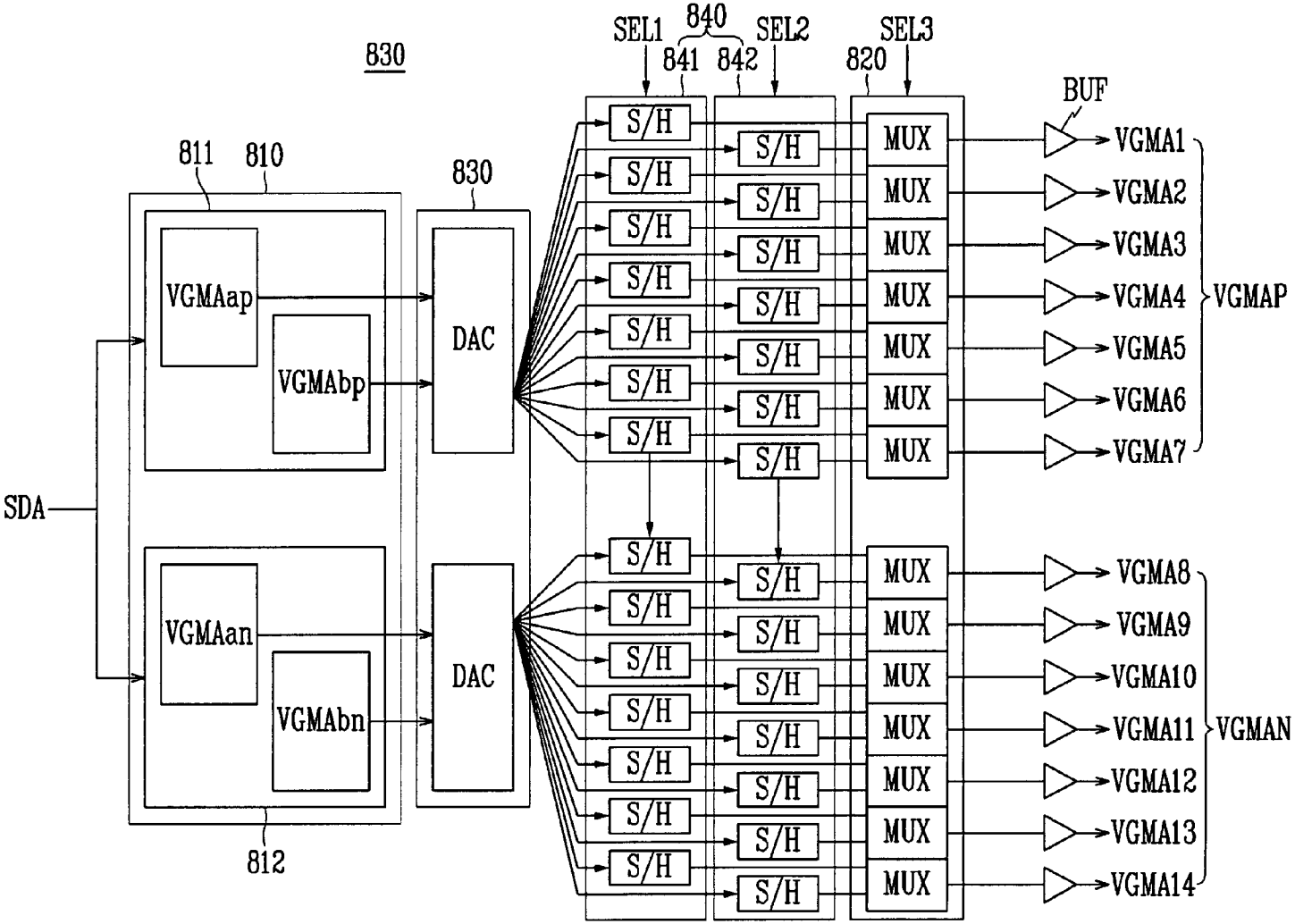
FIG. 10 is a block diagram of still another exemplary gray voltage generator according to still another exemplary embodiment of the present invention.

FIG. 10 is a block diagram illustrating the gray voltage generator 800 according to still another exemplary embodiment of the present invention.

Referring to FIG. 10, the gray voltage generator 800 according to this exemplary embodiment of the present invention includes a register 810 including a pair of digital registers 811 and 812, a converter 830 including a plurality of DACs connected to the digital registers 811 and 812, a sustainer 840 including sustain circuits 841 and 842 each having a plurality of sample and hold circuits SH connected to the DACs, a selector 820 including a plurality of multiplexers MUX connected to the two sustain circuits 841 and 842, and a plurality of buffers BUF connected to the selector 820.

Each of the digital registers 811 and 812 stores a pair of digital data VGMAapωVGMAan and VGMAbpωVGMAbn, and the converter 830 includes a pair of DACs suitable for the digital data. The number of sample and hold circuits SH corresponds to a number of the gray reference voltages to be generated. FIG. 10 illustrates an example in which seven positive gray reference voltages VGMAP and seven negative gray reference voltages VGMAN are generated and in which each of the sustain circuits 841 and 842 includes fourteen sample and hold circuits SH. Selection signals SEL1, SEL2 and SEL3 for selecting the sample and hold circuits S/H and the multiplexers MUX are input to the two sustain circuits 841 and 842 and the selector 820.

The gray voltage generator 800 illustrated in FIG. 10 reduces the number of DACs that occupy the largest area, thus reducing the area occupied by the exemplary gray voltage generator 800. Like in the gray voltage generator 800 illustrated in FIG. 7, when the sample and hold circuits S/H are positioned in output ports, the sample and hold circuits S/H are vulnerable to noise. However, the sample and hold circuits S/H of the gray voltage generator 800 illustrated in FIG. 10 are positioned in a central region, thus compensating for the drawback of being vulnerable to noise.

As described above, the exemplary embodiments of the gray voltage generator having the structure illustrated in FIG. 5 to FIG. 10 are provided in the form of a chip so that it is possible to reduce the area occupied on the PCB and to improve competitiveness in price.

While this invention has been described in connection with what is presently considered to be practical exemplary embodiments, it is to be understood that the present invention is not limited to the disclosed exemplary embodiments, but, on the contrary, is intended to cover various modifications and equivalent arrangements included within the spirit and scope of the appended claims.

What is claimed is:

1. A driving apparatus for a display device comprising a plurality of pixels arranged in a matrix and the pixel including first and second sub-pixels spatially divided, the driving apparatus comprising:

a memory for storing digital data on gray reference voltages;

a controller for calling the digital data to output the digital data together with a clock signal and at least one selection signal; and a gray voltage generator formed of an integrated circuit to receive the digital data from the controller and to generate gray reference voltage sets;

a data driver for receiving the gray reference voltage sets to generate a plurality of gray voltages and select gray voltages corresponding to image signals, wherein the gray voltage generator comprises:

first and second registers for storing the digital data for the first and second sub-pixels, respectively, wherein each of the digital data for the first sub-pixel and the digital data for the second sub-pixel comprises both of a value to be converted to positive gray reference voltages and a value to be converted to negative gray reference voltages for common voltage Vcom;

a selector including a plurality of multiplexers for receiving outputs of the first and second registers, the multiplexers selecting one between the digital data for the first sub-pixel and the digital data for the second sub-pixel; and a converter including a plurality of digital-analog converters connected to the multiplexers.

2. The driving apparatus of claim 1, wherein a pair of outputs from the first and second registers, respectively, are input to each of the multiplexers.

3. The driving apparatus of claim 2, further comprising buffers connected to respective digital-analog converters.

4. The driving apparatus of claim 3, wherein the selection signals are input to the multiplexers.

5. The driving apparatus of claim 4, wherein the data driver applies the selected gray voltages as data signals to the first and second sub-pixels.

6. The driving apparatus of claim 2, wherein the multiplexer selects one of the pair of outputs from the first and second registers according to the selection signal.

7. The driving apparatus of claim 1, wherein at least two pairs of outputs from the first and second registers, respectively, are input to each of at least some of the multiplexers.

8. The driving apparatus of claim 7, further comprising at least two sample and hold circuits connected to each of at least some of the digital-analog converters.

9. The driving apparatus of claim 8, wherein one of the selection signals is input to the multiplexers, and the other selection signals are input to the sample and hold circuits.

10. The driving apparatus of claim 1, wherein the digital data comprises two digital gray reference data sets respectively stored in the first register and the second register.

11. The driving apparatus of claim 10, wherein the digital gray reference data set stored in the first register corresponds to the first sub-pixel, and the digital gray reference data set stored in the second register corresponds to the second sub-pixel.

* * * * *